United States Patent [19]

Ina

[11] Patent Number: 4,501,123

[45] Date of Patent: Feb. 26, 1985

[54] COOLING APPARATUS FOR MACHINERY

[75] Inventor: Teruo Ina, Takarazuka, Japan

[73] Assignee: Mitsubishi Denki Kabushiki Kaisha, Tokyo, Japan

[21] Appl. No.: 552,913

[22] Filed: Nov. 17, 1983

[30] Foreign Application Priority Data

Dec. 3, 1982 [JP] Japan ..... 57-213012

[51] Int. Cl.[3] ..... F25D 15/00

[52] U.S. Cl. ..... 62/119; 165/104.21

[58] Field of Search ..... 62/119; 165/104.21

[56] References Cited

U.S. PATENT DOCUMENTS 1,700,839 2/1929 Gay ..... 165/104.21
3,614,693 10/1971 Frey ..... 165/104.21
3,906,261 9/1975 Ogura et al. ..... 165/104.21
4,173,996 11/1979 Pierce ..... 165/104.21

*Primary Examiner*—Ronald C. Capossela
*Attorney, Agent, or Firm*—Wenderoth, Lind & Ponack

[57] ABSTRACT

A cooling apparatus for machinery utilizing a vaporizable liquid refrigerant and constituted by a tank in which machinery to be cooled is immersed in the vaporizable liquid refrigerant sealed within the tank, a condensor disposed above the tank substantially horizontally, and distributing pipes connecting the tank with the condensor so as to convey the vapor produced from the vaporizable liquid refrigerant within the tank by the heat generated in the machinery to the condenser, and the vapor is condensed in the condenser, returning to the tank again through passages separately constituted in the distributing pipes.

5 Claims, 2 Drawing Figures

COOLING APPARATUS FOR MACHINERY

BACKGROUND OF THE INVENTION

The present invention relates to a cooling apparatus for machinery and more particularly to a cooling apparatus for machinery utilizing a vaporizable liquid refrigerant.

In this kind of a cooling apparatus, since a heat generating body such as the core or windings of a transformer is immersed in a vaporizable liquid refrigerant and is cooled by the latent heat of vaporization of the liquid, the cooling efficiency is high. In addition, since no mineral oil is used, advantages such as nonflammability, compactness, lightness, etc. can be obtained. Therefore, this kind of cooling apparatus has recently drawn much attention.

An example of this kind of the cooling apparatus is shown in FIG. 1 of the attached drawings.

In FIG. 1, there is shown a tank 1 having its upper end sealed by a cover 101. The machinery body 2 of the machinery to be cooled, e.g. a transformer is contained within the tank 1, the transformer comprising a core 201, a low voltage winding 202, and a high voltage winding 203, both windings 202 and 203 being wound around the core 201. The body 2 is provided with a first duct 204 between core 201 and low voltage winding 202 and a second duct 205 between low and high voltage windings 202 and 203, respectively. A liquid refrigerant 3 such as fleon 11 or the like, i.e. a vaporizable liquid refrigerant, is sealed within the tank 1 so that the machinery body 2 is entirely submerged therein. A condenser 4 is provided to condense the refrigerant vapor which is generated from the liquid refrigerant 3 when it cools the machinery body 2 by its latent heat of vaporization, this condensation generating condensed refrigerant 401. The condenser 4 is provided with a number of cooling tubes 402 through which passes the refrigerant vapor. One end portion of the condenser 4 and the tank 1 are connected together by a vapor pipe 5 which leads the refrigerant vapor generated from the liquid refrigerant 3 within tank 1 to the condenser 4. The other end portion of the condenser 4 and the tank 1 are connected by a return pipe 6 which returns the condensed refrigerant 401 which has condensed from the vaporized refrigerant in the condenser 4 to the tank 1, the lower end of the return pipe 6 extending to a point below the level of the liquid refrigerant 3 within the tank 1. As can be seen, the cooling tubes 402 of the condenser 4 are inclined so that the end near the return pipe 6 is lower than the opposite end.

The operation of the cooling apparatus described so far is as follows.

The heat generated by the core 201, and the low and high voltage windings 202 and 203, respectively, is transferred from their surfaces to the surrounding liquid refrigerant 3 within the tank 1 as well as to the liquid refrigerant 3 contained within the first and second ducts 204 and 205, respectively, the refrigerant liquids 3 being in contact with the peripheral surfaces of the ducts. Thus, the liquid refrigerant 3 absorbs the heat from the core 201 as well as from the low and high voltage windings 202 and 203, respectively. As a result, it transforms from the liquid to the vapor phase, and cools the core 201 as well as the low and high voltage windings 202 and 203, respectively, by this vaporization. The refrigerant vapor produced from the liquid refrigerant 3 is led to the cooling tubes 402 of the condenser 4 through the vapor pipe 5, the refrigerant vapor having its heat dissipated to the surrounding atmosphere to be condensed and thus transformed into the condensed refrigerant 401. The condensed refrigerant 401 flows through the inclined cooling tubes 402 towards the return pipe 6 to be returned again to the tank 1 through the return pipe 6. As the refrigerant vapor within the cooling tubes 402 condenses, the vapor pressure within the cooling tubes 402 decreases.

As a result, the refrigerant vapor produced from the liquid refrigerant 3 by the heat generated from the core 201 as well as the low and high voltage windings 202 and 203, respectively, flows into the cooling tubes 402 of the condenser 4. Thus, the cooling cycle is continuously repeated to continuously cool the core 201 as well as the low and high voltage windings 202 and 203, respectively.

Since the conventional cooling apparatus has a construction and operation such as that described above, the cooling tubes 402 of the condenser 4 have to be inclined, and the structure of the condenser 4 and the tank 1 is made complicated, increasing manufacturing costs.

U.S. Pat. No. 4,173,996 to Linden W. Pierce discloses an invention entitled "Heat Exchange Arrangement for Vaporization Cooled Transformers", wherein a condenser or a heat exchanger is provided with a plurality of inclined cooling tubes, and the condenser and the tank are connected together by a vapor intake pipe and a condensed coolant return pipe arranged at opposite ends of the heat exchanger. Thus, this patent differs from the present invention in that in the latter the cooling tubes are arranged horizontally, and the condenser and the tank are connected together by pipes at both ends of the condenser, each pipe acting simultaneously as a vapor intake pipe and a condensed coolant return pipe.

SUMMARY OF THE INVENTION

It is an object of the present invention to provide a cooling apparatus for machinery utilizing a vaporizable liquid refrigerant which can eliminate the defects in the conventional apparatus of this kind as described above.

It is another object of the present invention to provide a cooling apparatus for machinery utilizing a vaporizable liquid refrigerant which is provided with a condenser which is disposed horizontally.

It is a further object of the present invention to provide a cooling apparatus for machinery utilizing a vaporizable liquid refrigerant which has a simple contruction and is cheap to manufacture.

In accordance with the present invention a cooling apparatus for machinery utilizing vaporizable liquid refrigerant is provided which comprises a tank in which is received machinery to be cooled such that the machinery is entirely submerged in the vaporizable liquid refrigerant sealed within the tank, a condenser disposed above the tank, and distributing pipes which connect the tank to the condenser to convey the vaporized refrigerant within the tank which is vaporized by the heat generated in the machinery to the condenser and to cause it to be condensed therein, the distributing pipes simultaneously serving to return the liquid refrigerant to the tank.

In a preferred embodiment of the present invention the condenser is horizontally disposed above the tank.

BRIEF DESCRIPTION OF THE DRAWINGS

These and other objects of the present invention will become more readily apparent upon reading the following specification and upon reference to the accompanying drawings, in which.

DESCRIPTION OF PREFERRED EMBODIMENT

Figure 1:
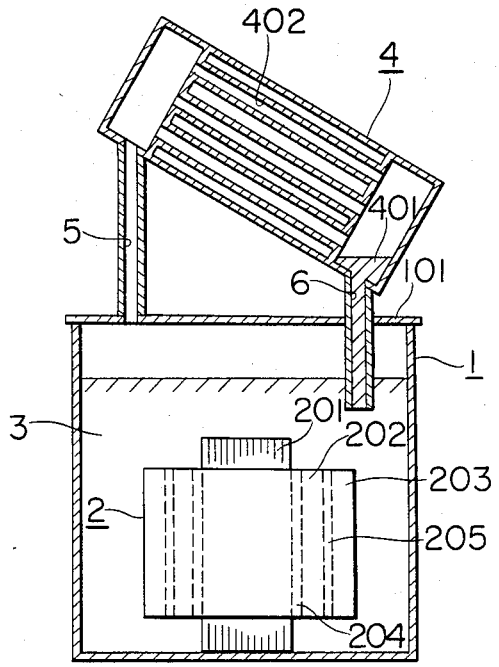
FIG. 1 PRIOR ART
FIG. 1 is a longitudinal sectional front elevation of an example of a conventional cooling apparatus of this kind.
Figure 2:
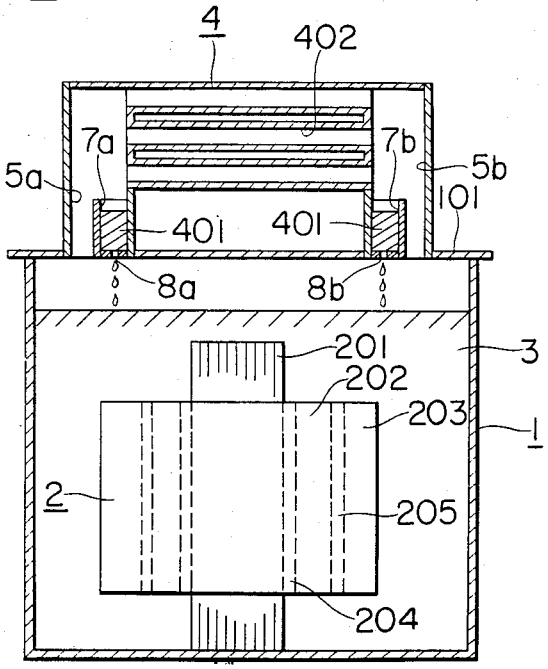
FIG. 2 is a longitudinal sectional front elevation of one embodiment of the present invention.

Referring now to FIG. 2 of the attached drawings in which is shown a longitudinal sectional front elevation of one embodiment of the present invention and in which parts similar to those in FIG. 1 are designated by the same reference numerals as used in FIG. 1, the tank 1 and the condenser 4 are connected together by distributing pipes 5*a* and 5*b*. Provided within the pipes 5*a* and 5*b* are condensed refrigerant accumulators *7a* and *7b* which act to temporarily accumulate therein the condensed refrigerant 401 that is condensed in the condenser 4, and the condensed refrigerant 401 is thence returned to the tank 1 by gravity through holes 8*a* and 8*b*, for example, formed in the cover 101. The cover 101 simultaneously constitutes the bottoms of the condensed refrigerant accumulators *7a* and *7b*. The condenser 4 and the cooling tubes 402 are arranged substantially horizontally, and the cooling tubes 402 of the condenser 4 are made with sufficiently large dimensions so that the cooling tubes 4 cannot be filled with the condensed refrigerant 401 during operation. On the other hand, the bores 8*a* and 8*b* have sufficiently small dimensions that the refrigerant vapor vaporized from the liquid refrigerant 3 within the tank 1 cannot penetrate into condensed refrigerant accumulators *7a* and *7b*, and at the same time the bores 8*a* and 8*b* are dimensioned so that condensed refrigerant 401 can accumulate in the condensed refrigerant accumulators *7a* and *7b* to definite levels therein. Thus, in the distributing pipes 5*a* and 5*b* the passages which carry the vaporized refrigerant from the tank 1 to the condenser 4 and the passages which carry condensed refrigerant 401 from the condenser 4 to the tank 1 are separately formed.

The operation of the embodiment illustrated in FIG. 2 and described above is as follows.

The refrigerant vapor produced from the liquid refrigerant within the tank 1 by the heat generated in the machinery body 2, i.e. the core 201 as well as the low and high voltage windings 202 and 203, respectively, is led to the cooling tubes 402 of the condenser 4 through the vaporized refrigerant passages formed in the pipes 5*a* and 5*b*. The vaporized refrigerant is condensed within the cooling tubes 402 to become the condensed refrigerant 401, and it flows leftwards or rightwards therein as viewed in FIG. 2, accumulating in condensed refrigerant accumulators *7a* and *7b*, and then falling into tank 1 through the bores 8*a* and 8*b*, the accumulators *7a*, *7b* and the bores 8*a*, 8*b* forming passages for the condensed refrigerant in the pipes 5*a* and 5*b*. Thus, the pressure within the cooling tubes 402 decreases by the amount of refrigerant transformed from the vapor phase to the liquid phase in the condenser 4 so that more vaporized refrigerant within tank 1 is allowed to flow into the cooling tubes 402 through distributing tubes 5*a* and 5*b*. Thus, the cooling cycle is carried out continuously without interruption.

Although the present invention has been explained as used in cooling a transformer, the machinery to be positioned within tank 1 may be any other appropriate type.

It is to be understood that although a single preferred embodiment of the present invention has been illustrated and described above, it is not to be limited thereto except insofar as such limitations are included in the following claims.

What is claimed is:

1. A cooling apparatus for machinery comprising:

a tank having a body of vaporizable refrigerant sealed therein and in which the machinery to be cooled is immersed;

a condensing means above said tank and having a plurality of cooling tubes therein;

distributing pipes connecting said tank to said condensing means, and distributing pipes each extending from the tip of said tank to said cooling tubes for conveying vapor phase vaporizable refrigerant generated within said tank as the result of heating by the heat generated in said machinery to said cooling tubes; and a condensed refrigerant accumulating means positioned in said distributing pipes and filling only a portion of the cross-section of the respective distributing pipe for receiving liquid refrigerant condensed in said cooling tubes and having restricted passage means extending into said tank for returning liquid refrigerant to said tank, said restricted passage being sufficiently small that when liquid refrigerant is accumulated in said accumulating means the vapor phase of said vaporizable refrigerant from said tank cannot penetrate through it.

2. A cooling apparatus as claimed in claim 1 wherein said distributing pipes are provied at both ends of said condensing means.

3. A cooling apparatus as claimed in claim 1 wherein said cooling tubes each has a dimension such that it is at the most only partly filled with condensed liquid refrigerant during operation of said condensing means.

4. A cooling apparatus as claimed in claim 1 wherein said cooling tubes are straight tubes and are positioned substantially horizontally.

5. A cooling apparatus as claimed in claim 1 wherein said tank has cover on which said condensing means is mounted, and said restricted passage is at least one bore in said cover.

* * * * *